United States Patent [19]

Plumbridge

[11] Patent Number: 4,645,105

[45] Date of Patent: Feb. 24, 1987

[54] GOLFING ACCESSORY

[76] Inventor: Michael M. R. Plumbridge, 244 Darkes Lane, Potters Bar, Hertfordshire, England

[21] Appl. No.: 694,761

[22] Filed: Jan. 25, 1985

[30] Foreign Application Priority Data

Jan. 30, 1984 [GB] United Kingdom ..... 8402420
Mar. 16, 1984 [GB] United Kingdom ..... 8406982

[51] Int. Cl.[4] ..... A45F 5/00
[52] U.S. Cl. ..... 224/269; 224/277; 224/252
[58] Field of Search ..... 224/274, 269, 252, 918, 224/277; D2/400

[56] References Cited

U.S. PATENT DOCUMENTS

| | | | |
|---|---|---|---|
| D. 277,900 | 3/1985 | Reed | 224/918 X |
| 2,665,830 | 1/1954 | Fowler | 224/252 |
| 2,682,981 | 7/1954 | Previdi | 224/918 |
| 3,010,628 | 11/1961 | Kowalczyk | 224/274 |
| 3,830,415 | 8/1974 | Jacobson et al. | 224/918 |
| 4,032,054 | 6/1977 | Duncan | 224/274 |
| 4,157,152 | 6/1979 | Blastic | 224/274 |

*Primary Examiner*—Stephen Marcus
*Assistant Examiner*—David Voorhees
*Attorney, Agent, or Firm*—Parkhurst & Oliff

[57] ABSTRACT

A golfer's accessory comprising a flat backing support body for a score card having a socketed block holding the score card onto the body. At the back of the board is formed a clip constituted by a relatively wide resilient tongue rendering the accessory suitable for clipping on to the flexible part of a golf bag or a trouser band.

1 Claim, 5 Drawing Figures

GOLFING ACCESSORY

DESCRIPTION

This invention relates to a golfing accesory and has the objective to provide a holder for a scorecard, such holder being provided with storage facilities for a pencil and for golf tees, ball markers and a pitch mark repairer.

In accordance with the present invention a golfer's accessory for the purposes set forth above comprises a substantially rigid support for a score card, means at the front surface of the support to secure detachably the card and, at the rear surface a clip formed to engage and be retained on a relatively wide flexible element such as the top of a golf bag, a pocket or a trouser band.

A preferred form of clip comprises a relatively wide tongue with a smoothly profiled surface to bear resiliently against the inside surface of the element which the clip engages. The preferred clip is so structured as to define a widened entry to a clipping constriction and the tongue is resiliently deformable to widen the constriction.

In an embodiment the support has at the upper part thereof a mounting block having sockets to receive golf tees, the mark repairer and the pencil. The front of said block has shallow sockets to receive ball markers.

A particular embodiment of the invention will now be described by way of example and with reference to the accompanying informal drawing wherein.

The device illustrated comprises a flat rectangular body piece 10, conveniently moulded from a rigid plastic. Integrally formed and at the rear of said body 10 is a clip 11 so formed as to make the device suitable for clipping on to a golf bag, part of a golfer's clothing or other wide flexible element.

Figure 4:
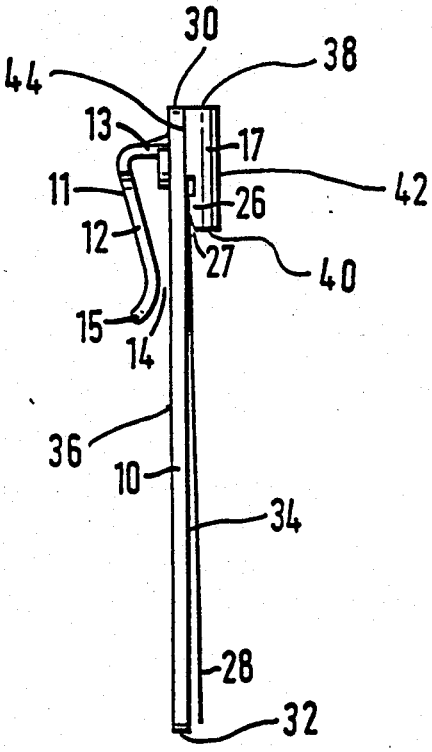
FIG. 4 is a side view.

The clip 11 comprises a relatively wide tongue 12 joined to the body by a short web 13; the profile of the tongue is best seen in FIG. 4. From the web 13 the tongue extends downwardly and inwardly to the clipping constriction 14. A convex formation 15 below constriction 14 provides a smooth and deepened entry to the clip. A correspondingly recessed aperture 16 is formed through the body behind the clip.

Figure 1:
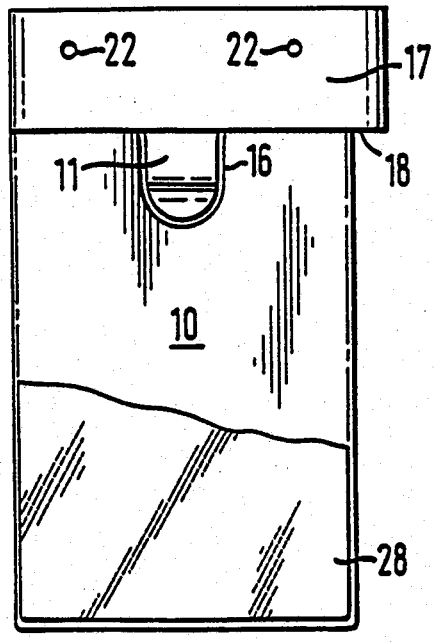
FIG. 1 is a front view of a device in accordance with the invention.
Figure 2:
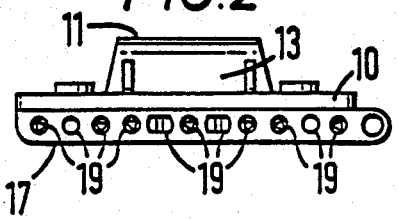
FIG. 2 is a top view.
Figure 3:
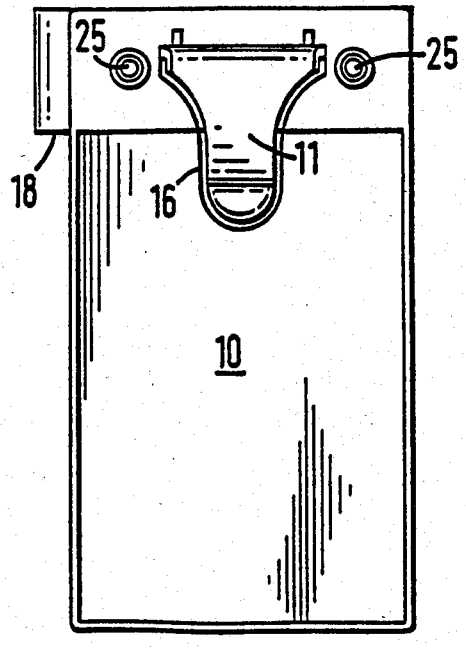
FIG. 3 is a rear view.
Figure 5:
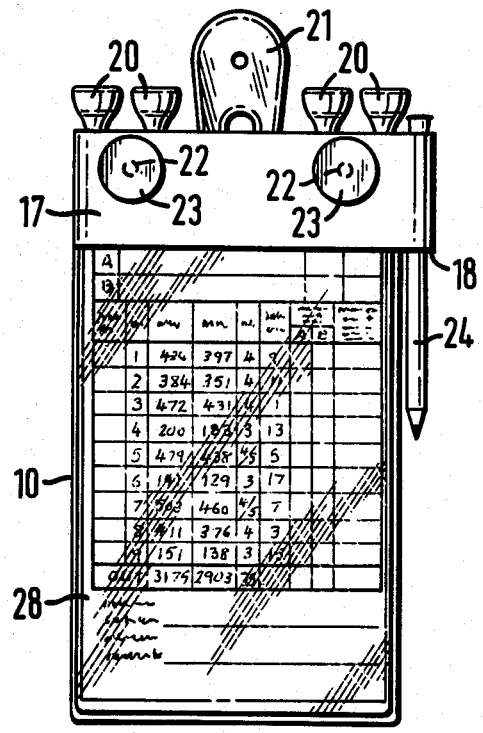
FIG. 5 is a front view of the loaded device.

A separately formed rectangular block 17 extends, in register, across the upper part of the block with a lateral extension 18. As can best be seen in FIG. 2 the top of the block has sockets 19 to receive tees 20 and a small plastic fork 21 serving to repair the green (see FIG. 5). The front of the block has shallow sockets 22 to receive ball markers 23 whilst extension 18 has a through socket for pencil 24.

The block 17 is fixed to body 10 by cylindrical studs 25 which are an interference fit in bores in the body.

As can be seen from FIG. 4 the lower part of the block is in the form of a dependent clip with an enlarged head 26 and a V-profile entry slot 27. The head 26 has sufficient resilience to allow a card to be inserted and securely held. A transparent shield 28 is clamped between block 17 and body 10.

Additionally, the body 10 may be characterized as having a first edge surface 30, a second edge surface 32, a front face 34 and a back face 36. The block 17, similarly, is characterized as having a first edge surface 38, a second edge surface 40, a front face 42 and a back face 44.

It will thus be appreciated that the device described above can easily be attached or detached to a golf bag or a pocket, trouser top or other item of clothing by virtue of its shape and resilience. The special construction of the block moreover enables the score card to be inserted and removed readily. Storage is provided on a neat and detachable manner, moreover, for the small items which the golfer must carry, tees, ball markers, divot repairer and pencil.

I claim:

1. A golfing accessory comprising:

(a) a rigid backing support having a first edge surface, a second edge surface, a front face and a back face, said support having a plurality of holes passing from said front face to said back face, said holes located at a position closer to said first edge surface than said second edge surface of said support, said front face having a width and length generally corresponding to a width and length of a scorecard;

(b) a separate rigid socketed block having a first edge surface, a second edge surface, a front face and a back face, said back face having a plurality of studs formed thereon, said plurality of studs communicating with said holes in said support for forming an interference fit with said support, said first edge surface of said block being substantially parallel and flush with said first edge surface of said support, said back face of said block and said front face of said support being substantially engaged when said studs and said holes form said interference fit, said block having a width generally corresponding to the width of said front face of said support, said socketed block having a plurality of holes passing from said first edge surface to said second edge surface and into said front face for detachably receiving tees, ballmarkers, a pitch repairer and a writing implement;

(c) a clipping portion formed between a lower surface of said back face of said block and an upper surface of said front face of said support, said lower surface of said block being closer to said second edge suface of said block than said first edge suface of said block, and said upper surface of said support being closer to said first edge surface of said support than said second edge surface of said support, said clipping portion having a V-profile entry slot for easy insertion of said scorecard, and wherein said clipping portion engages a corresponding width of said scorecard along an upper surface of said scorecard; and (d) a flexible resilient tongue having a widened entry into a clipping restriction area, said tongue integrally attached to said back face of said support at a position closer to said first edge surface of said support than said second edge surface of said support.

* * * * *